US009617778B2

(12) United States Patent
Fukui et al.

(10) Patent No.: US 9,617,778 B2
(45) Date of Patent: Apr. 11, 2017

(54) OPENING AND CLOSING BODY CONTROL METHOD AND APPARATUS FOR A VEHICLE

(71) Applicant: AISIN SEIKI KABUSHIKI KAISHA, Kariya-shi (JP)

(72) Inventors: Norio Fukui, Kuwana (JP); Ryo Asano, Owariasahi (JP); Hitoshi Takayanagi, Kariya (JP)

(73) Assignee: AISIN SEIKI KABUSHIKI KAISHA, Kariya-shi (JP)

( * ) Notice: Subject to any disclaimer, the term of this patent is extended or adjusted under 35 U.S.C. 154(b) by 141 days.

(21) Appl. No.: 14/613,709

(22) Filed: Feb. 4, 2015

(65) Prior Publication Data

US 2015/0218871 A1 Aug. 6, 2015

(30) Foreign Application Priority Data

Feb. 6, 2014 (JP) ..... 2014-020862

(51) Int. Cl.
*G08B 21/00* (2006.01)
*E05F 15/77* (2015.01)
(Continued)

(52) U.S. Cl.
CPC ..... *E05F 15/77* (2015.01); *E05C 17/003* (2013.01); *E05C 17/203* (2013.01); *E05F 15/73* (2015.01);
(Continued)

(58) Field of Classification Search
CPC ..... E05F 3/00
(Continued)

(56) References Cited

U.S. PATENT DOCUMENTS 4,674,230 A 6/1987 Takeo et al.

FOREIGN PATENT DOCUMENTS

DE 40 25 507 A1 2/1992
DE 42 29 412 C1 10/1993
(Continued)

OTHER PUBLICATIONS

Extended European Search Report issued Jul. 10, 2015 in Patent Application No. 15153798.2.
U.S. Appl. No. 14/613,737, filed Feb. 4, 2015, Fukui, et al.

*Primary Examiner* — Jeffrey Hofsass
(74) *Attorney, Agent, or Firm* — Oblon, McClelland, Maier & Neustadt, L.L.P.

(57) ABSTRACT

An opening and closing body control apparatus includes: a first signal receiving unit receiving a first detection signal indicating the presence or absence of contact of a user with an operating portion of an opening and closing body; a second signal receiving unit receiving a second detection signal indicating a movement speed of the body; and a signal output unit outputting a control signal regulating a holding force of the body to a holding force regulating device, wherein the control signal regulating the holding force to a first holding force less than a second holding force is output to the device according to the first detection signal indicating that the contact has been detected, and when the second detection signal indicating that the movement speed body is greater than or equal to a predetermined speed is received when the holding force is the first holding force, the control signal regulating the holding force to the first holding force is output to the device regardless of the first detection signal.

13 Claims, 11 Drawing Sheets

(51) Int. Cl.

| | |
|---|---|
| ***G08B 21/22*** | (2006.01) |
| ***E05F 15/73*** | (2015.01) |
| ***E05C 17/20*** | (2006.01) |
| ***E05C 17/00*** | (2006.01) |

(52) U.S. Cl.
CPC ..... *G08B 21/22* (2013.01); *E05Y 2201/242* (2013.01)

(58) Field of Classification Search
USPC ..... 340/686.6, 540; 49/28, 31, 32
See application file for complete search history.

(56) References Cited

FOREIGN PATENT DOCUMENTS

DE 10 2004 020 484 A1 11/2005
DE 10 2009 001 668 A1 9/2010

OPENING AND CLOSING BODY CONTROL METHOD AND APPARATUS FOR A VEHICLE

CROSS REFERENCE TO RELATED APPLICATIONS

This application is based on and claims priority under 35 U.S.C. §119 to Japanese Patent Application 2014-020862, filed on Feb. 6, 2014, the entire contents of which are incorporated herein by reference.

TECHNICAL FIELD

This disclosure relates to opening and closing body control method and apparatus for controlling a holding force of an opening and closing body for a vehicle.

BACKGROUND DISCUSSION

In the related art, various techniques for holding the degree of opening of an opening and closing body of a vehicle at an arbitrary position are proposed. For example, JP 61-191781A (Reference 1) discloses a technique in which a sensor for detecting the presence or absence of contact of a human body with a door of an automobile is provided and when the human body is in contact with the door, holding of the door is released and when the human body is not in contact with the door, the door is held. Such an opening degree holding mechanism is provided, whereby at the time of the opening and shutting of the door, it is possible to automatically hold the door at an arbitrary degree of opening which an occupant wants.

However, it cannot be said that a method of controlling a holding force of a door based on only a sensor for detecting the presence or absence of contact of a human body necessarily provides good operability. For example, if the human body is separated from the door, a door holding mode is entered, and thus a brake is applied, and therefore, it is not possible to perform opening and shutting of the door with inertia by giving momentum to the door. That is, if the body does not touch an operating portion of the door, the door cannot be moved, and therefore, an impression that operability is poor relative to a normal door without an opening degree holding mechanism is sometimes given to a user.

SUMMARY

Thus, a need exists for an opening and closing body control method and apparatus which are not suspectable to the drawback mentioned above.

An aspect of this disclosure provides an opening and closing body control apparatus including: a first signal receiving unit configured to receive a first detection signal indicating the presence or absence of contact of a user with an operating portion of an opening and closing body; a second signal receiving unit configured to receive a second detection signal indicating a movement speed of the opening and closing body; and a signal output unit configured to output a control signal for regulating a holding force of the opening and closing body to a holding force regulating device, wherein the control signal for regulating the holding force of the opening and closing body to a first holding force less than a second holding force is output to the holding force regulating device according to the first detection signal indicating that the contact of the user with the operating portion has been detected, and when the second detection signal indicating that the movement speed of the opening and closing body is greater than or equal to a predetermined speed is received when the holding force of the opening and closing body is the first holding force, the control signal for regulating the holding force of the opening and closing body to the first holding force is output to the holding force regulating device regardless of the first detection signal.

Another aspect of this disclosure provides an opening and closing body control method of a vehicle having a contact detection sensor which detects the presence or absence of contact of a user with an operating portion of an opening and closing body, a speed detection sensor which detects a movement speed of the opening and closing body, and a holding force regulating device for regulating a holding force of the opening and closing body, the method including: regulating the holding force of the opening and closing body to a first holding force less than a second holding force according to a first detection signal indicating that the contact of the user with the operating portion has been detected; and maintaining the holding force of the opening and closing body at the first holding force regardless of the first detection signal when a second detection signal indicating that the movement speed of the opening and closing body is greater than or equal to a predetermined speed is received when the holding force of the opening and closing body is the first holding force.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Embodiment 1

Opening and closing body control method and apparatus according to Embodiment 1 disclosed here will be described by using FIGS. 1 to 7.

Figure 1:
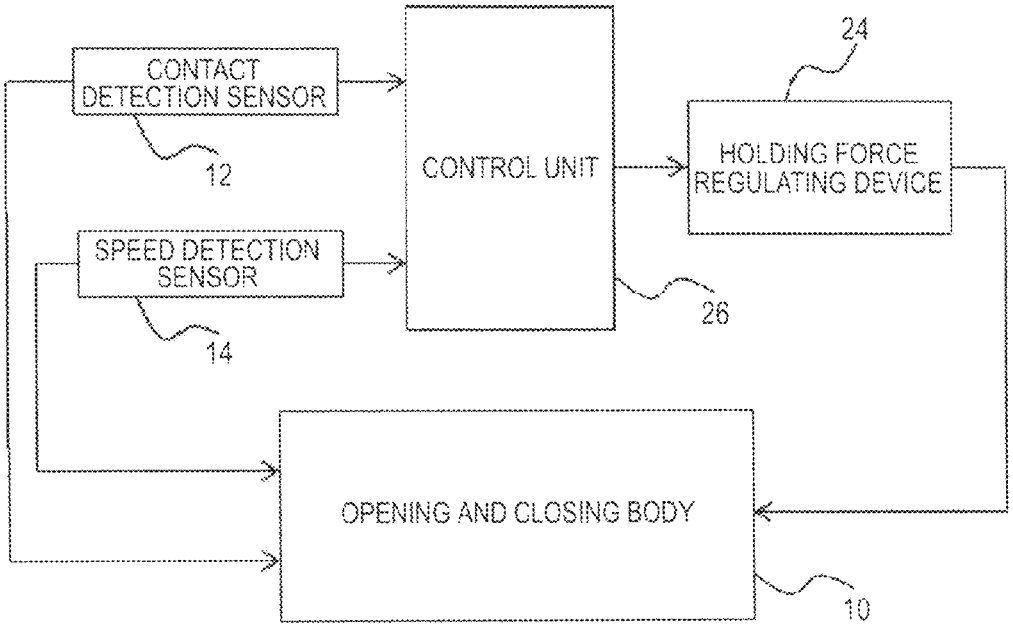
FIG. 1 is a block diagram showing the structure of an opening and closing body control apparatus according to Embodiment 1 disclosed here.
Figure 4:
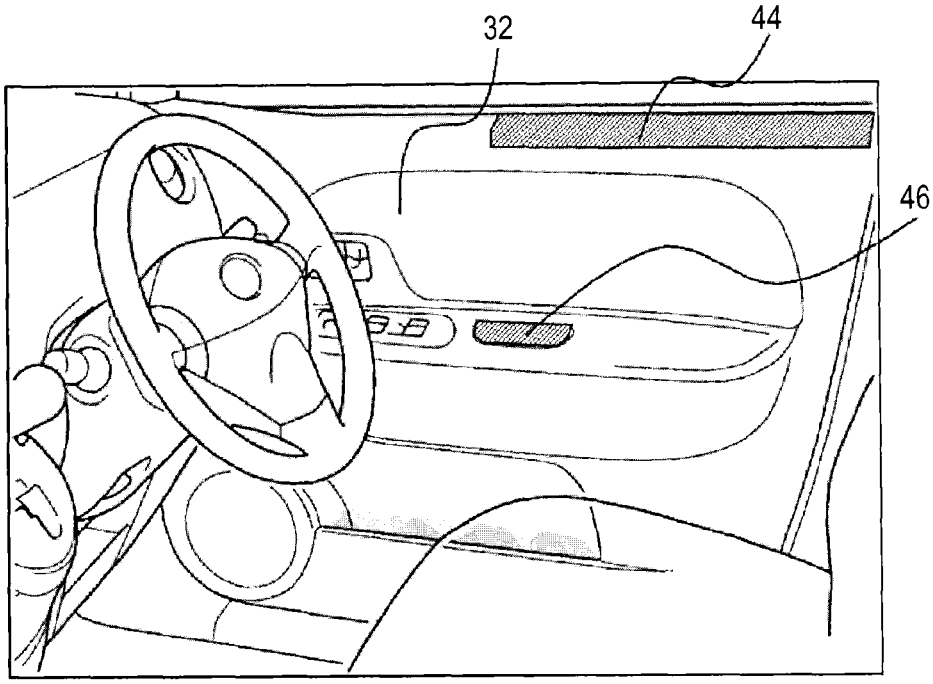
FIG. 4 is a diagram (Part 2) showing another example of the operating portion of the opening and closing body by a user.
Figure 5:
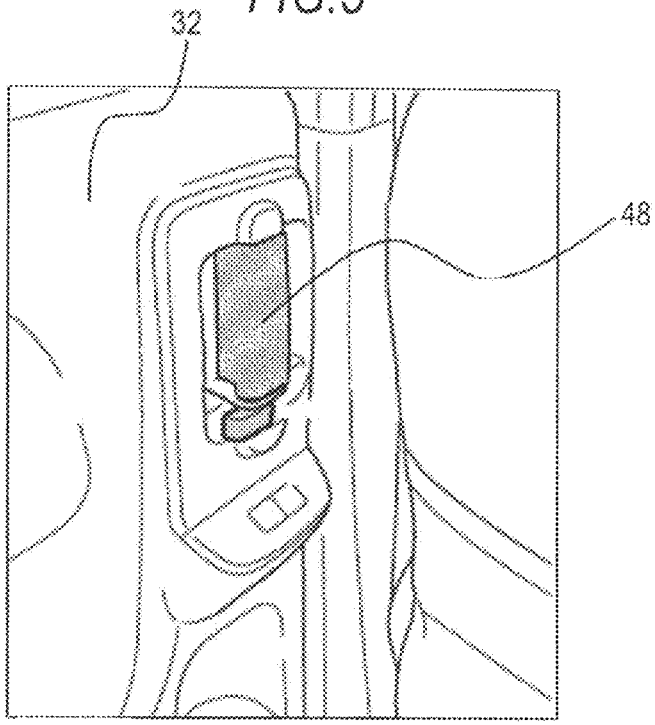
FIG. 5 is a diagram (Part 3) showing another example of the operating portion of the opening and closing body by a user.
Figure 6:
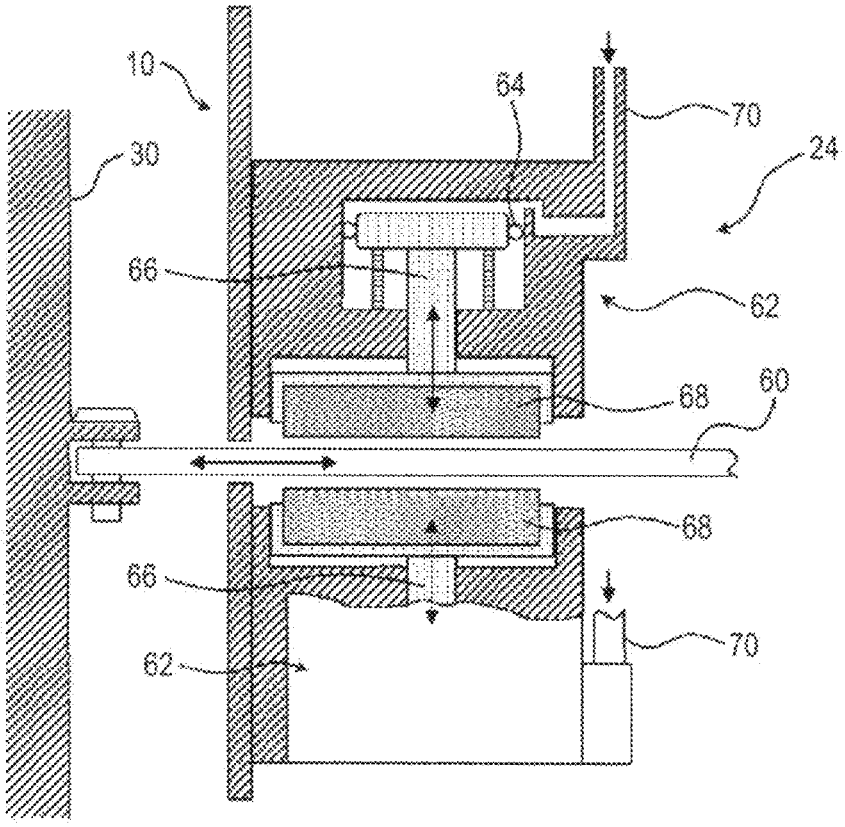
FIG. 6 is a schematic diagram showing an example of a holding force regulating device.
Figure 7:
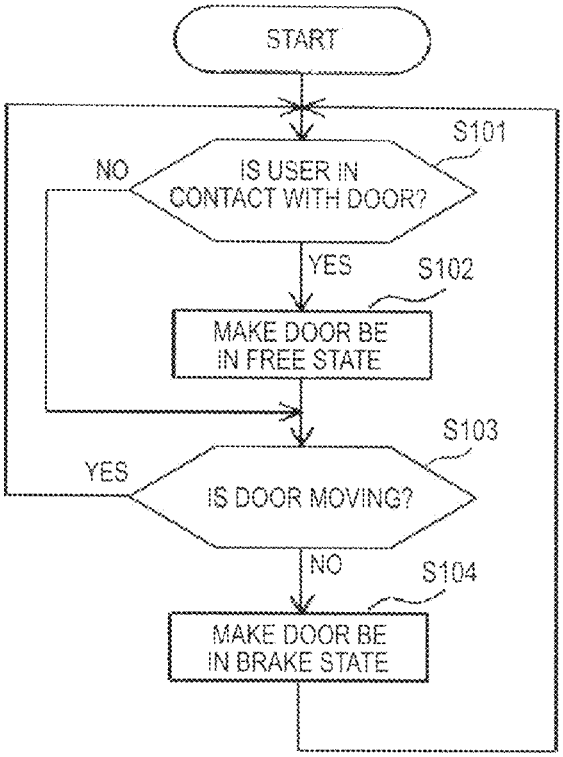
FIG. 7 is a flowchart showing an opening and closing body control method according to Embodiment 1 disclosed here.

FIG. 1 is a block diagram showing the structure of the opening and closing body control apparatus according to this embodiment. FIGS. 2 to 5 are diagrams describing an opening and closing body of a vehicle and examples of an operating portion of the opening and closing body by a user. FIG. 6 is a schematic diagram showing an example of a holding force regulating device. FIG. 7 is a flowchart showing the opening and closing body control method according to this embodiment.

First, the structure of the opening and closing body control apparatus according to this embodiment will be described by using FIGS. 1 to 6.

The opening and closing body control apparatus according to this embodiment has a contact detection sensor 12, a speed detection sensor 14, a holding force regulating device 24, and a control unit 26, as shown in FIG. 1. The control unit 26 is connected to the contact detection sensor 12 and the speed detection sensor 14 and made so as to be able to receive output signals from the contact detection sensor 12 and the speed detection sensor 14. Further, the control unit 26 is connected to the holding force regulating device 24 and made so as to be able to output a control signal for driving the holding force regulating device 24 to the holding force regulating device 24.

Next, each section of the opening and closing body control apparatus according to this embodiment will be described in detail.

Figure 2:
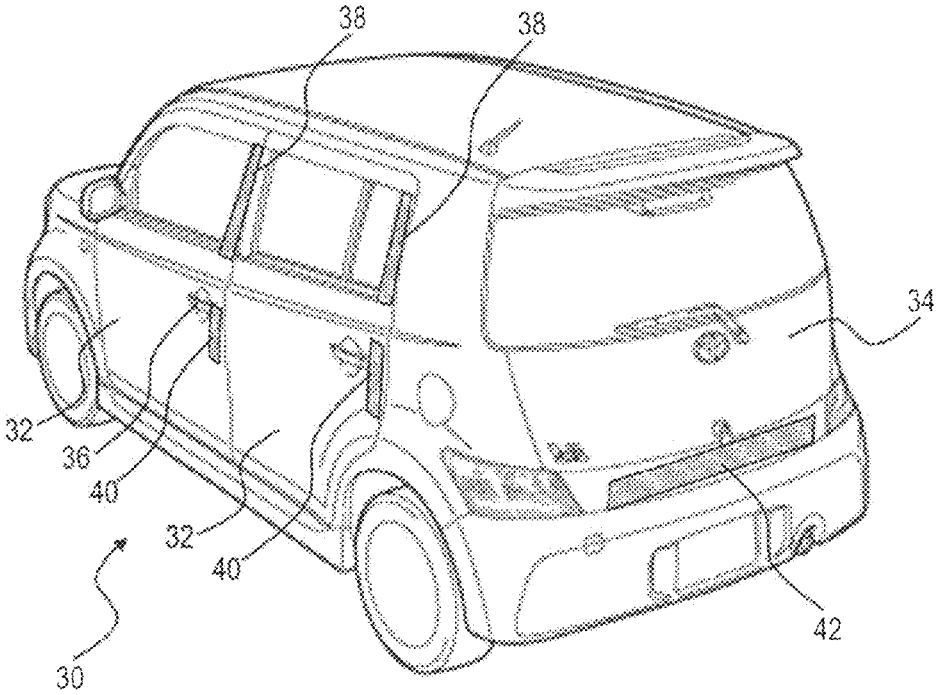
FIG. 2 is a diagram showing an opening and closing body of a vehicle and an example of an operating portion of the opening and closing body by a user.

An opening and closing body 10 is a structural body having an opening and shutting mechanism provided in a vehicle. The opening and closing body 10 is not particularly limited. However, for example, in a vehicle 30 as shown in FIG. 2, a side door 32 provided at a side portion of the vehicle 30, a back door 34 provided at a back portion of the vehicle 30, or the like is equivalent thereto. The opening and closing body 10 is not limited to a swinging door such as the side door 32 shown in FIG. 2 but may be a sliding door.

The contact detection sensor 12 is a sensor for detecting a user being in contact with an operating portion of the opening and closing body 10. As a sensor capable of detecting the contact of the user with the operating portion, a capacitance sensor can be given as an example. As the merits of the capacitance sensor, a design property not being made worse, a contact state being able to be reliably detected even with light contact, as compared to a switch or the like, and the like can be given as an example.

An installation location of the contact detection sensor 12 is the operating portion of the opening and closing body 10. Here, in this specification, the "operating portion" of the opening and closing body 10 shall refer to a site of the opening and closing body 10 with which a user comes into contact when opening and shutting the opening and closing body 10.

Figure 3:
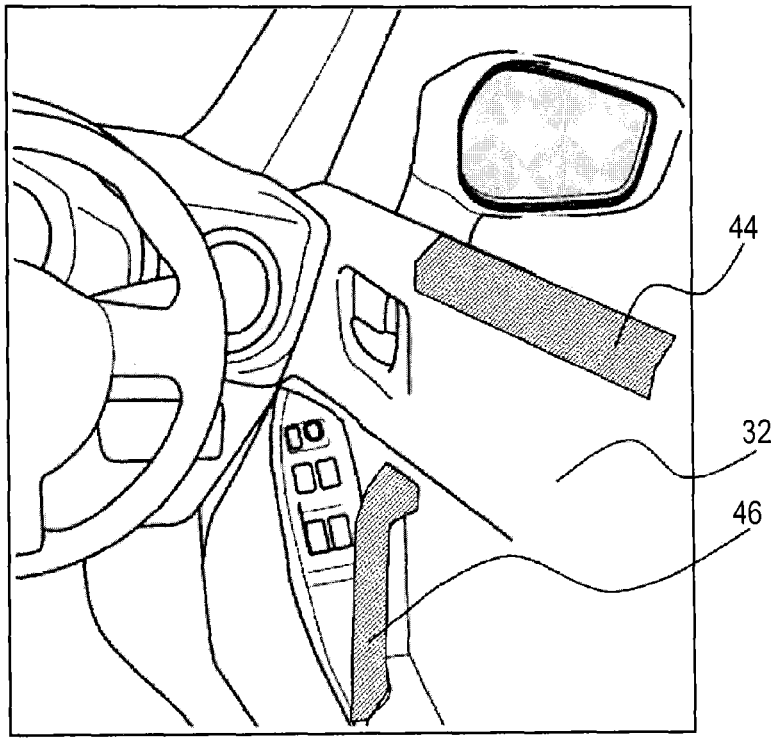
FIG. 3 is a diagram (Part 1) showing another example of the operating portion of the opening and closing body by a user.

As the installation location of the contact detection sensor 12 in an exterior portion of the vehicle 30, for example, as shown in FIG. 2, an outside handle portion 36, a pillar portion 38, or a door panel portion 40 of the side door 32, a lower end portion 42 of the back door 34, or the like is assumed. Further, as the installation location of the contact detection sensor 12 in an interior portion of the vehicle 30, for example, as shown in FIGS. 3 to 5, a door trim portion 44, a grip portion 46, an inside handle portion 48, or the like of the side door 32 is assumed.

It is preferable that a site with which a user is likely to come into contact when opening and shutting the opening and closing body 10, although contact by the user is not originally intended, for example, in the above-described example, the pillar portion 38, the door panel portion 40, the door trim portion 44, or the like, is also included in the operating portion. As an example, a case where a user opens the side door 32 and then gets into the vehicle 30 shown in FIG. 2 will be taken and described as an example.

A user first holds the outside handle portion 36 and pulls the side door 32, thereby opening the door to some extent, and then moves toward a gap of the slightly opened side door 32 as a preparation motion for getting into the vehicle. If the user moves toward the gap of the side door 32, it is difficult to open the side door 32 to a desired degree of opening necessary for getting into the vehicle while holding the outside handle portion 36. Therefore, the user grips a site of the opening and closing body 10 which it is easier to hold, for example, the pillar portion 38 or the door panel portion 40 of the side door 32, by shifting from the outside handle portion 36, opens the side door 32 to a desired degree of opening, and thereafter, gets into a car. In such a series of door opening operations, the pillar portion 38 or the door panel portion 40 of the side door 32 is also the operating portion.

The speed detection sensor 14 is a sensor for detecting the movement speed of the opening and closing body 10. As a sensor capable of measuring the movement speed of the opening and closing body 10, it is not particularly limited. However, a pulse sensor can be given as an example. For example, by installing a pulse sensor at a check arm portion of a door check and measuring a time interval of a pulse, it is possible to calculate the movement speed of the opening and closing body 10. In addition, if the number of pulses is counted by the pulse sensor, it is possible to detect the amount of movement (displacement), that is, it is also possible to use the pulse sensor as a displacement detection sensor.

The holding force regulating device 24 is for regulating a holding force of the opening and closing body 10. Here, the holding force of the opening and closing body 10 is a force to fix the opening and closing body 10 at a certain position, and the smaller the holding force, the more the opening and closing body 10 easily moves, and the greater the holding force, the more difficult it becomes for the opening and closing body 10 to move.

In this embodiment, the holding force regulating device 24 shall be able to form at least two holding states, a "free state" and a "brake state". Here, the "free state" is a state where the holding force of the opening and closing body 10 is small, and is, for example, a state where the opening and closing body 10 can be freely operated with a light operating force approximately corresponding to an operating force which is necessary in a flat portion of a normal door check. Further, the "brake state" is a state where the holding force of the opening and closing body 10 is large, and is, for example, a state where the opening and closing body 10 is restrained with a holding force equivalent to the holding force of the normal door check. In addition, the holding forces of the opening and closing body 10 in the "free state" and the "brake state" can be appropriately changed in consideration of necessity, convenience, or the like.

An example of the holding force regulating device 24 will be described by using FIG. 6. The holding force regulating device 24 shown in FIG. 6 has a cylinder 62 disposed so as to sandwich a check arm 60 from above and below, a piston 66 provided in the cylinder 62 so as to be able to slide with a packing 64 interposed therebetween, and a friction member 68 provided at an end portion on the check arm 60 side of the piston 66.

The check arm 60 is pivotally fixed to a main body of the vehicle 30 at an end portion thereof and is made so as to reciprocate in a right-left direction in the drawing between the upper and lower cylinders 62 disposed in the opening and closing body 10 according to the opening and shutting operation of the opening and closing body 10. If gas is introduced from a gas inlet 70 provided in the cylinder 62 by an air compressor (not shown), the piston 66 moves toward the check arm 60 due to the pressure of the gas, and thus the check arm 60 is pinched by the friction members 68 provided at the tips of the pistons 66. By appropriately adjusting the pressure of the gas which is introduced into the cylinder 62, it is possible to restrain the check arm 60, that is, the opening and closing body 10, with a desired holding force. Further, by venting the gas in the cylinder 62, it is possible to release the restraint of the check arm 60 by the friction members 68 and reduce the holding force of the check arm 60, that is, the opening and closing body 10.

In addition, the holding force regulating device 24 is not limited to that shown in FIG. 6 as long as it is a holding force regulating device capable of regulating the holding force of the opening and closing body 10 to a predetermined holding force.

The control unit 26 is for controlling the holding force of the opening and closing body 10 by outputting a control signal for driving the holding force regulating device 24 according to the output signals from the contact detection sensor 12 and the speed detection sensor 14.

The control unit 26 has a contact detection signal receiving unit (first signal receiving unit) for receiving the output signal (a first detection signal) from the contact detection sensor 12, and a speed detection signal receiving unit (second signal receiving unit) for receiving the output signal (a second detection signal) from the speed detection sensor 14. Further, the control unit 26 has a holding force control signal output unit (signal output unit) for outputting a holding force control signal for regulating the holding force of the opening and closing body 10 to the holding force regulating device 24.

In addition, in this specification, not only the entire system but also only the control unit 26 is sometimes referred to as the "opening and closing body control apparatus".

Next, the opening and closing body control method according to this embodiment will be described by using FIGS. 1 and 7.

The holding force of the opening and closing body 10 is controlled as shown below according to, for example, a flowchart shown in FIG. 7 by the control unit 26. In addition, a flowchart for realizing the opening and closing body control method according to this embodiment is not limited to that shown in FIG. 7 and a modification or a change can be appropriately made in a range in which it is possible to exhibit the effects that this embodiment aims for.

First, in step S101, the control unit 26 receives the output signal from the contact detection sensor 12. In a case where an output signal indicating the contact of a user with the operating portion of the opening and closing body 10 has been received from the contact detection sensor 12, the routine proceeds to step S102, and in a case where an output signal indicating the contact of the user with the operating portion of the opening and closing body 10 is not received from the contact detection sensor 12, the routine proceeds to step S103.

In step S102, the control unit 26 outputs a holding force control signal for making the opening and closing body 10 have a holding force in the free state to the holding force regulating device 24, and thus the opening and closing body 10 is made to be in the free state by the holding force regulating device 24. After step S102, the routing proceeds to step S103.

The user being in contact with the operating portion of the opening and closing body 10 is determined to be that the user has the intention to try to open and shut the opening and closing body 10. Therefore, when the output signal indicating the contact of the user with the operating portion of the opening and closing body 10 has been received, the holding force of the opening and closing body 10 is made to be in the free state, thereby enabling a smooth operation of the opening and closing body 10 by the user.

In step S103, the control unit 26 receives the speed detection signal from the speed detection sensor 14 and determines whether or not the opening and closing body 10 is moving at a speed greater than or equal to a predetermined value. In a case where a speed detection signal indicating that the opening and closing body 10 is stopped or is moving at a speed less than the predetermined value has been received from the speed detection sensor 14, the routine proceeds to step S104, and in a case where a speed detection signal indicating that the opening and closing body 10 is moving at a speed greater than or equal to the predetermined value has been received, the routine returns to step S101.

That is, when the opening and closing body 10 is moving at a speed greater than or equal to the predetermined value, the holding force of the opening and closing body 10 is maintained in the free state regardless of whether or not the user is in contact with the opening and closing body 10. For this reason, for example, even when the user releases the hand from the opening and closing body 10 in an attempt to open and shut the opening and closing body 10 with inertia by giving momentum thereto, the opening and closing body 10 can be operated according to the intention of the user without becoming a door holding mode. In this way, it is possible to improve the operability of the opening and closing body 10, as compared to a case of controlling the holding force of the opening and closing body 10 based on only a signal of a sensor for detecting the presence or absence of contact of a user.

In step S104, the control unit 26 outputs a holding force control signal for making the opening and closing body 10 have a holding force in the brake state to the holding force regulating device 24, and thus the opening and closing body 10 is made to be in the brake state by the holding force regulating device 24. Making the opening and closing body 10 be in the brake state is for preventing the opening and closing body 10 from freely running due to its own weight, wind, or the like thereafter under a determination that the movement speed of the opening and closing body 10 becoming less than the predetermined value is that the user has the intention to try to stop the opening and closing body 10.

In this way, it is possible to prevent the opening and closing body 10 from colliding with another vehicle parked adjacently or the user's hand or foot from being pinched, due to the opening and closing body 10 freely running.

Further, due to entering the brake state when the user has stopped the opening and closing body 10, the user can find that a brake has been applied to the opening and closing body 10, and therefore, it is possible to prevent a sense of unease that "the opening and closing body 10 might move when having released the hand" from being given.

When the user operates the opening and closing body 10, a case where the user temporarily stops the operation in the middle and immediately resumes the operation is also assumed. In such a case, if the opening and closing body 10 is immediately made to be in the brake state when the operation has been temporarily stopped, it is also conceivable that the user who tries to perform the operation again feels the braking state, thereby receiving an impression that operability is poor. Therefore, in consideration of such a case, in a case where a state in which the opening and closing body 10 is stopped or is moving at a speed less than a predetermined value has continued for a predetermined time, the holding state of the opening and closing body 10 may be changed from the free state to the brake state.

After step S104, the routing returns to step S101 and the same steps are repeated.

In this manner, according to this embodiment, the holding force of the opening and closing body 10 is regulated to the free state not only when the user is in contact with the opening and closing body 10, but also when the opening and closing body 10 is moving at a speed greater than or equal to a predetermined speed, and therefore, even when the user releases the hand from the opening and closing body 10 in an attempt to open and shut the opening and closing body 10 with inertia by giving momentum thereto, the opening and closing body 10 can be operated according to the intention of the user without becoming a door holding mode. In this way, it is possible to improve the operability of the opening and closing body 10, as compared to a case of controlling the holding force of the opening and closing body 10 based on only a signal of a sensor for detecting the presence or absence of contact of a user.

Further, when the movement speed of the opening and closing body 10 has become less than a predetermined speed, the holding force of the opening and closing body is regulated to the brake state, and therefore, it is possible to prevent a sense of unease that "the opening and closing body 10 might move when having released the hand" from being given to the user. Further, it is possible to prevent the opening and closing body from freely running after the user releases the hand.

Embodiment 2

Opening and closing body control method and apparatus according to Embodiment 2 disclosed here will be described by using FIGS. 8 and 9. The same constituent elements as those in the opening and closing body control method and apparatus according to Embodiment 1 shown in FIGS. 1 to 7 are denoted by the same reference numerals and description is omitted or simplified.

Figure 8:
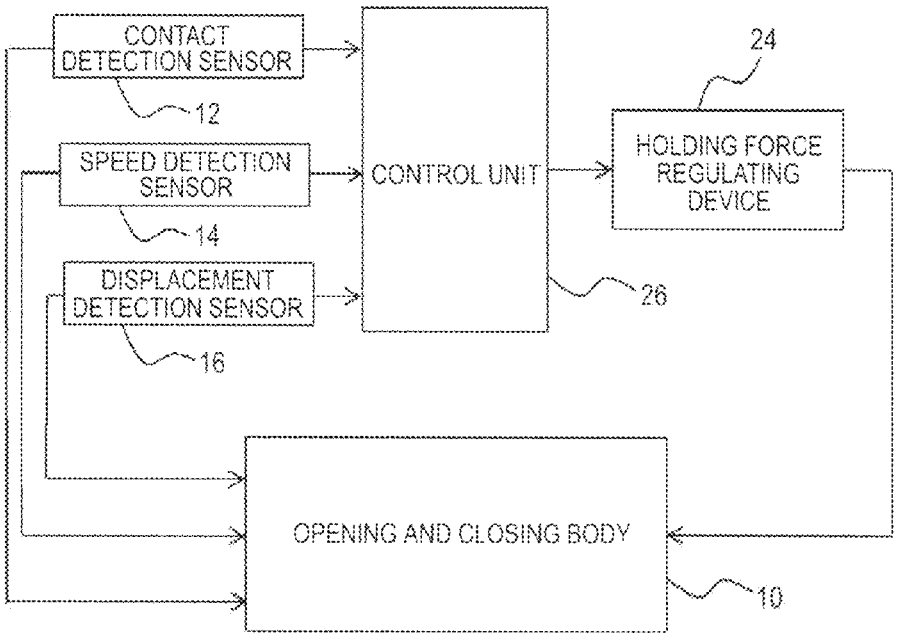
FIG. 8 is a block diagram showing the structure of an opening and closing body control apparatus according to Embodiment 2 disclosed here.

FIG. 8 is a block diagram showing the structure of the opening and closing body control apparatus according to this embodiment. FIG. 9 is a flowchart showing the opening and closing body control method according to this embodiment.

First, the structure of the opening and closing body control apparatus according to this embodiment will be described by using FIG. 8.

The opening and closing body control apparatus according to this embodiment is the same as the opening and closing body control apparatus according to Embodiment 1 shown in FIG. 1 except that the opening and closing body control apparatus according to this embodiment further has a displacement detection sensor 16, as shown in FIG. 8. The control unit 26 is also connected to the displacement detection sensor 16 and is made so as to be able to receive an output signal from the displacement detection sensor 16.

The displacement detection sensor 16 is a sensor for detecting the displacement (the movement) of the opening and closing body 10. As a sensor capable of detecting the displacement of the opening and closing body 10, it is not particularly limited. However, a pulse sensor can be given as an example. For example, by installing a pulse sensor at the check arm portion of the door check and detecting the movement of the check arm and a direction thereof, it is possible to detect the opening and closing body 10 having moved and a movement direction thereof. The displacement detection sensor 16 and the speed detection sensor 14 may be separately provided. However, in a case where a pulse sensor is used as the speed detection sensor 14, the pulse sensor can also be used as the displacement detection sensor 16, as described above. A pulse sensor which is used in the calculation of a speed, displacement, and a position can be shared.

The holding force regulating device 24 shall be able to form at least three holding states: a "free state", a "weak brake state", and a "medium brake state".

In this specification, the "free state" is a state where the holding force of the opening and closing body 10 is small, and shall be, for example, a state where the opening and closing body 10 can be freely operated with a light operating force approximately corresponding to an operating force which is necessary in a flat portion of a normal door check. The "weak brake state" shall be a state of being slightly heavier than the free state, but lighter than the holding force of the normal door check, and be a state to the extent that an operator can feel a change in an operating force to the free state. The "medium brake state" is a state of a holding force equivalent to the holding force of the normal door check and shall be a state where the opening and closing body does not freely run under a predetermined environment. The "brake state" in Embodiment 1 is equivalent to the "medium brake state" in this embodiment. Further, although it does not appear in this embodiment, a "strong brake state" shall be a state of being heavier than the holding force of the normal door check and be a state where the opening and closing body 10 never freely runs even when on a steep slope or in strong wind.

In addition, the expressions, the "free state", the "weak brake state", the "medium brake state", and the "strong brake state", are for convenience in order to facilitate understanding, and the holding forces of the opening and closing body 10 in these states can be appropriately changed in consideration of necessity, convenience, or the like. In this specification, the holding force in the free state is sometimes expressed as a first holding force, the holding force in the weak brake state is sometimes expressed as a second holding force, the holding force in the medium brake state is sometimes expressed as a third holding force, and the holding force in the strong brake state is sometimes expressed as a fourth holding force.

The control unit 26 further has a displacement detection signal receiving unit (third signal receiving unit) for receiving the output signal (a third detection signal) from the displacement detection sensor 16. The control unit 26 outputs a control signal for driving the holding force regulating device 24, according to the output signals from the contact detection sensor 12, the speed detection sensor 14, and the displacement detection sensor 16, thereby controlling the holding force of the opening and closing body 10.

Next, the opening and closing body control method according to this embodiment will be described by using FIGS. 8 and 9.

The holding force of the opening and closing body 10 is controlled as shown below according to, for example, a flowchart shown in FIG. 9 by the control unit 26. In addition, a flowchart for realizing the opening and closing body control method according to this embodiment is not limited to that shown in FIG. 9 and a modification or a change can be appropriately made in a range in which it is possible to exhibit the effects that this embodiment aims for.

Since step S201 to step S203 in this embodiment are the same as step S101 to step S103 in Embodiment 1, description is omitted here.

In step S203, when it is determined that the opening and closing body 10 is stopped or is moving at a speed less than a predetermined value, the routine proceeds to step S204.

In step S204, the control unit 26 outputs a holding force control signal for making the opening and closing body 10 have the holding force in the weak brake state to the holding force regulating device 24, and thus the opening and closing body 10 is made to be in the weak brake state by the holding force regulating device 24. Making the opening and closing body 10 be in the weak brake state rather than the medium brake state (the brake state in Embodiment 1) in this step is for improving operability by reducing an operating force when a user moves the opening and closing body 10 again after the user temporarily stops the opening and closing body 10. Even in the weak brake state rather than the medium brake state, the user can find that a brake has been applied to the opening and closing body 10, and therefore, it is possible to prevent a sense of unease that "the opening and closing body 10 might move when having released the hand" from being given. After step S204, the routine proceeds to step S205.

In step S205, the control unit 26 receives the output signal from the contact detection sensor 12. In a case where an output signal indicating the contact of the user with the operating portion of the opening and closing body 10 has been received from the contact detection sensor 12, the routine proceeds to step S206, and in a case where the output signal indicating the contact of the user with the operating portion of the opening and closing body 10 has not been received, the routine proceeds to step S207.

In step S206, the control unit 26 receives the output signal from the displacement detection sensor 16. In a case where an output signal indicating the displacement (the movement) of the opening and closing body 10 has been received from the displacement detection sensor 16, the routine proceeds to step S202 and the opening and closing body 10 is made to be in the free state. The output signal indicating the displacement of the opening and closing body 10 is for enabling a smoother movement by reducing the holding force of the opening and closing body 10 because it is determined that the user has the intention to try to change the degree of opening of the opening and closing body 10. In a case where the output signal indicating the displacement (the movement) of the opening and closing body 10 has not been received from the displacement detection sensor 16, the routine returns to step S205 and the weak brake state is maintained.

In step S207, the control unit 26 outputs a holding force control signal for making the opening and closing body 10 have the holding force in the medium brake state to the holding force regulating device 24, and thus the opening and closing body 10 is made to be in the medium brake state by the holding force regulating device 24. After step S207, the routine returns to step S201 and the same steps are repeated.

If the user releases the hand from the opening and closing body 10 when the opening and closing body 10 is in the weak brake state, there is a concern that the opening and closing body 10 may freely run due to its own weight, wind, or the like. Therefore, in step S205, the presence or absence of the contact of the user with the opening and closing body 10 is detected, and when the user is not in contact with the opening and closing body 10, in step S207, the opening and closing body 10 is made to be in the medium brake state. In this way, it is possible to prevent the opening and closing body 10 from colliding with another vehicle parked adjacently or the user's hand or foot from being pinched, due to the opening and closing body 10 freely running after the user releases the hand.

In this manner, according to this embodiment, after the holding state becomes the weak brake state due to the movement speed of the opening and closing body 10 becoming less than a predetermined speed, in a case where the user has released the hand from the opening and closing body 10, the holding force of the opening and closing body 10 is changed from the weak brake state to the medium brake state, and therefore, it is possible to more efficiently prevent the opening and closing body 10 from colliding with another vehicle parked adjacently or the user's hand or foot from being pinched, due to the opening and closing body 10 freely running after the user releases the hand.

In addition, after the holding state becomes the weak brake state due to the movement speed of the opening and closing body 10 becoming less than a predetermined speed, when the user is in contact with the opening and closing body 10, the holding force of the opening and closing body 10 is maintained in the weak brake state, and when the opening and closing body 10 has been displaced, the holding force is made to be in the free state, and therefore, when the user tries to move the opening and closing body 10 again, it is possible to smoothly perform an operation.

Embodiment 3

Opening and closing body control method and apparatus according to Embodiment 3 disclosed here will be described by using FIG. 10. The same constituent elements as those in the opening and closing body control methods and apparatuses according to Embodiments 1 and 2 shown in FIGS. 1 to 9 are denoted by the same reference numerals and description is omitted or simplified.

Figure 10:
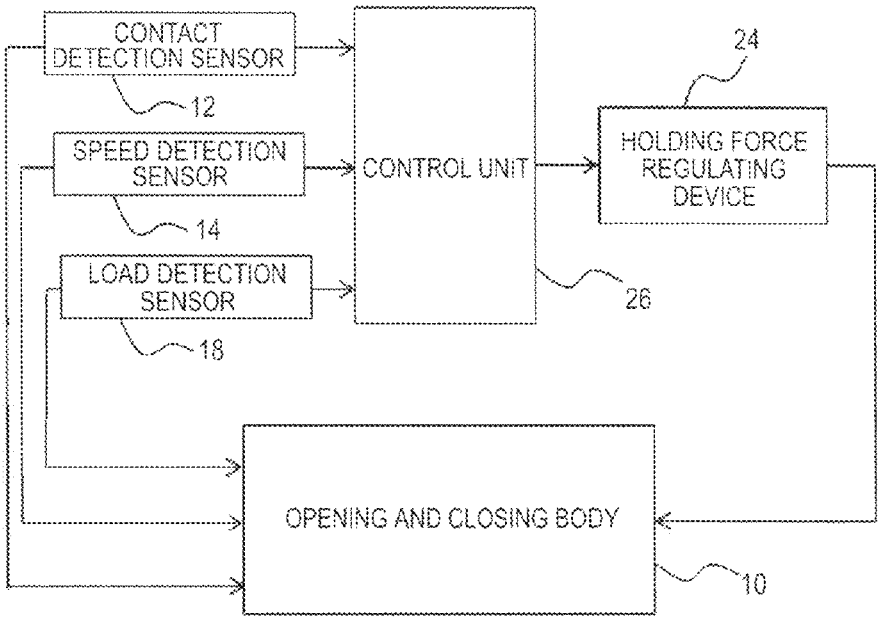
FIG. 10 is a block diagram showing the structure of an opening and closing body control apparatus according to Embodiment 3 disclosed here.

FIG. 10 is a block diagram showing the structure of the opening and closing body control apparatus according to this embodiment.

First, the structure of the opening and closing body control apparatus according to this embodiment will be described by using FIG. 10.

The opening and closing body control apparatus according to this embodiment is the same as the opening and closing body control apparatus according to Embodiment 2 shown in FIG. 8 except that the opening and closing body control apparatus according to this embodiment has a load detection sensor 18 instead of the displacement detection sensor 16, as shown in FIG. 10. The control unit 26 is connected to the load detection sensor 18 and is made so as to be able to receive an output signal from the load detection sensor 18.

The load detection sensor 18 is a sensor for detecting a load which is applied to the opening and closing body 10, that is, an operating force having been applied to the opening and closing body 10 by a user. As a sensor capable of detecting a load which is applied to the opening and closing body 10, it is not particularly limited. However, a sensor for detecting a load which is applied to a hinge portion at the time of an operation of the opening and closing body 10, or the like can be given as an example. The load detection sensor 18 can detect a load having been applied to the opening and closing body 10 and a direction of the load (whether it is an opening direction or a shutting direction).

The control unit 26 has a load detection signal receiving unit (third signal receiving unit) for receiving the output signal (a third detection signal) from the load detection sensor 18. The control unit 26 outputs a control signal for driving the holding force regulating device 24, according to the output signals from the contact detection sensor 12, the speed detection sensor 14, and the load detection sensor 18, thereby controlling the holding force of the opening and closing body 10.

In addition, in this specification, the displacement detection sensor 16 which is used to detect the direction of displacement of the opening and closing body 10 by the user and the load detection sensor 18 which is used to detect the direction of a load which is applied to the opening and closing body 10 are sometimes referred to comprehensively as a displacement detection sensor. Further, in this case, an output signal from the sensor shall be referred to as a displacement detection signal, and a unit for receiving the signal shall be referred to as displacement detection signal receiving unit.

Figure 9:
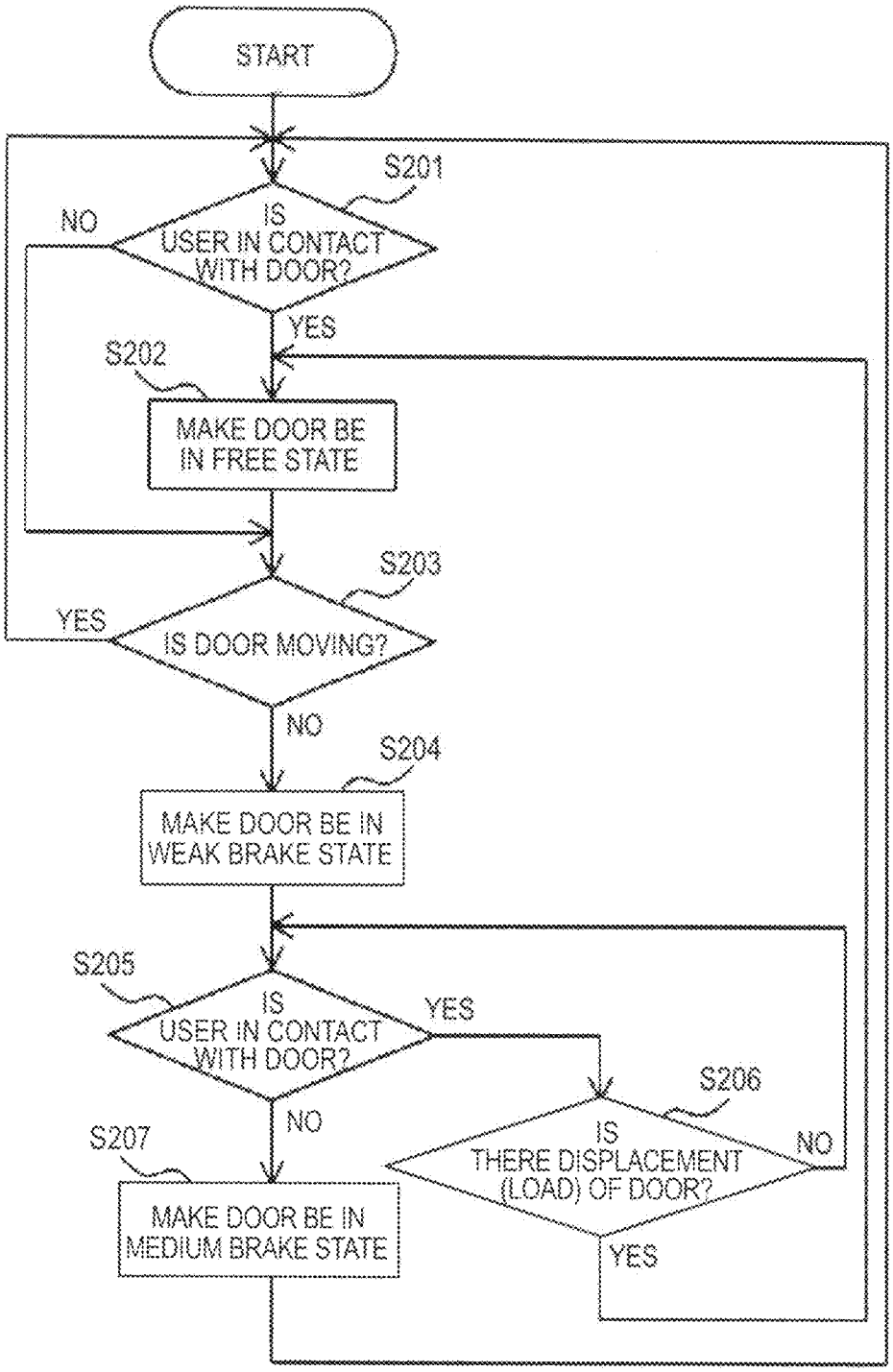
FIG. 9 is a flowchart showing opening and closing body control methods according to Embodiments 2 and 3 disclosed here.

The opening and closing body control method according to this embodiment is the same as the opening and closing body control method according to Embodiment 2 shown in FIG. 9 except that instead of the displacement of the opening and closing body 10, a load which is applied to the opening and closing body 10 is detected in step S206.

In this manner, according to this embodiment, after the holding state becomes the weak brake state due to the movement speed of the opening and closing body 10 becoming less than a predetermined speed, in a case where the user has released the hand from the opening and closing body 10, the holding force of the opening and closing body 10 is changed from the weak brake state to the medium brake state, and therefore, it is possible to more efficiently prevent the opening and closing body 10 from colliding with another vehicle parked adjacently or the user's hand or foot from being pinched, due to the opening and closing body 10 freely running after the user releases the hand.

Further, after the holding state becomes the weak brake state due to the movement speed of the opening and closing body 10 becoming less than a predetermined speed, when the user is in contact with the opening and closing body 10, the holding force of the opening and closing body 10 is maintained in the weak brake state, and when the opening and closing body 10 has been displaced, the holding force is made to be in the free state, and therefore, when the user tries to move the opening and closing body 10 again, it is possible to smoothly perform an operation.

Embodiment 4

Opening and closing body control method and apparatus according to Embodiment 4 disclosed here will be described by using FIGS. 11 to 13. The same constituent elements as those in the opening and closing body control methods and apparatuses according to Embodiments 1 to 3 shown in FIGS. 1 to 10 are denoted by the same reference numerals and description is omitted or simplified.

Figure 11:
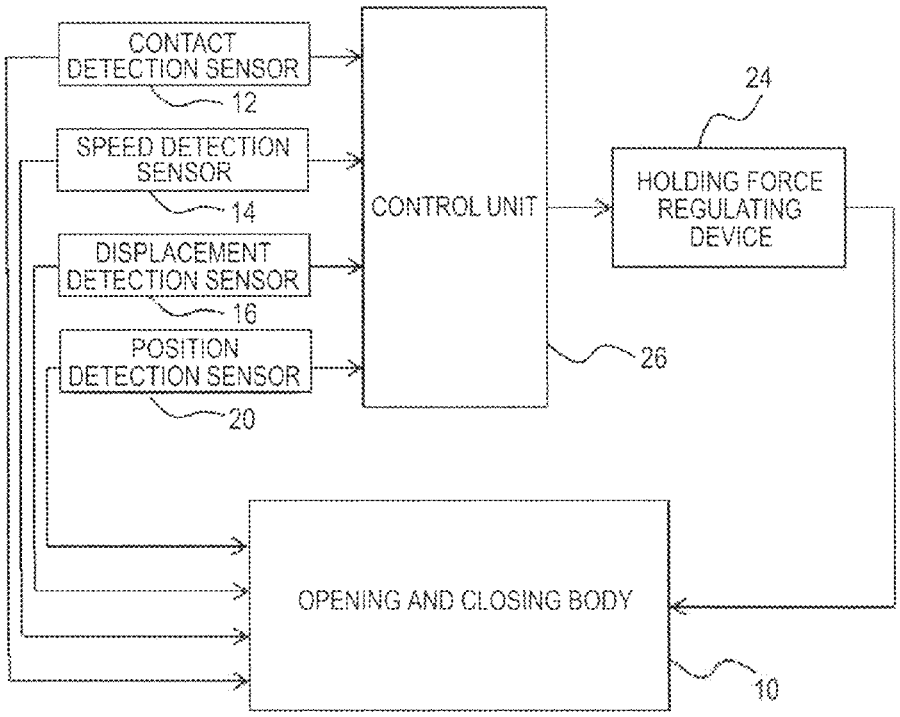
FIG. 11 is a block diagram showing the structure of an opening and closing body control apparatus according to Embodiment 4 disclosed here.

FIG. 11 is a block diagram showing the structure of the opening and closing body control apparatus according to this embodiment. FIG. 12 is a schematic diagram showing an example of range setting of a free area and a brake area of the opening and closing body. FIG. 13 is a flowchart showing the opening and closing body control method according to this embodiment.

First, the structure of the opening and closing body control apparatus according to this embodiment will be described by using FIGS. 11 and 12.

The opening and closing body control apparatus according to this embodiment is the same as the opening and closing body control apparatus according to Embodiment 2 shown in FIG. 8 except that the opening and closing body control apparatus according to this embodiment further has a position detection sensor 20, as shown in FIG. 11. The control unit 26 is also connected to the position detection sensor 20 and is made so as to be able to receive an output signal from the position detection sensor 20.

The position detection sensor 20 is a sensor for detecting the position of the opening and closing body 10. As a sensor capable of detecting the position of the opening and closing body 10, it is not particularly limited. However, a pulse sensor can be given as an example. For example, by installing a pulse sensor at the check arm portion of the door check and detecting the position of the check arm, it is possible to detect the position, that is, the degree of opening, of the opening and closing body 10. The displacement detection sensor 16 and the position detection sensor 20 may be separately provided. However, in a case where a pulse sensor is used as the displacement detection sensor 16, the pulse sensor can also be used as the position detection sensor 20. A pulse sensor which is used in the calculation of a speed, displacement, and a position can be shared.

In this specification, the position (the degree of opening) of the opening and closing body 10 shall be able to take at least three stages, a "full closing", a "free area", and a "brake area". The position detection sensor 20 detects whether the opening and closing body 10 is at a position of the "full closing", is at a position of the "free area", or is at a position of the "brake area".

Here, in this specification, the "full closing" shall refer to a state where the opening and closing body 10 is fully closed, that is, a state where a door latch is engaged (also including a half latch state). In addition, at the fully closed position, the opening and closing body 10 is held by the door latch, and therefore, the holding force may be that in the free state.

Further, the "brake area" shall refer to an area from a predetermined degree of opening to a mechanical fully open position. The brake area is an area in which further movement in an opening direction of the opening and closing body 10 with inertia without an operation by the user is not allowed. The predetermined degree of opening can also be set by the user. For example, when performing parking in a narrow space, or the like, the degree of opening to the extent that the opening and closing body 10 does not hit the surroundings when opening the opening and closing body 10 can be set as the predetermined degree of opening.

The "free area" shall refer to an area in an open state where the degree of opening is smaller than that in the brake area.

Figure 12:
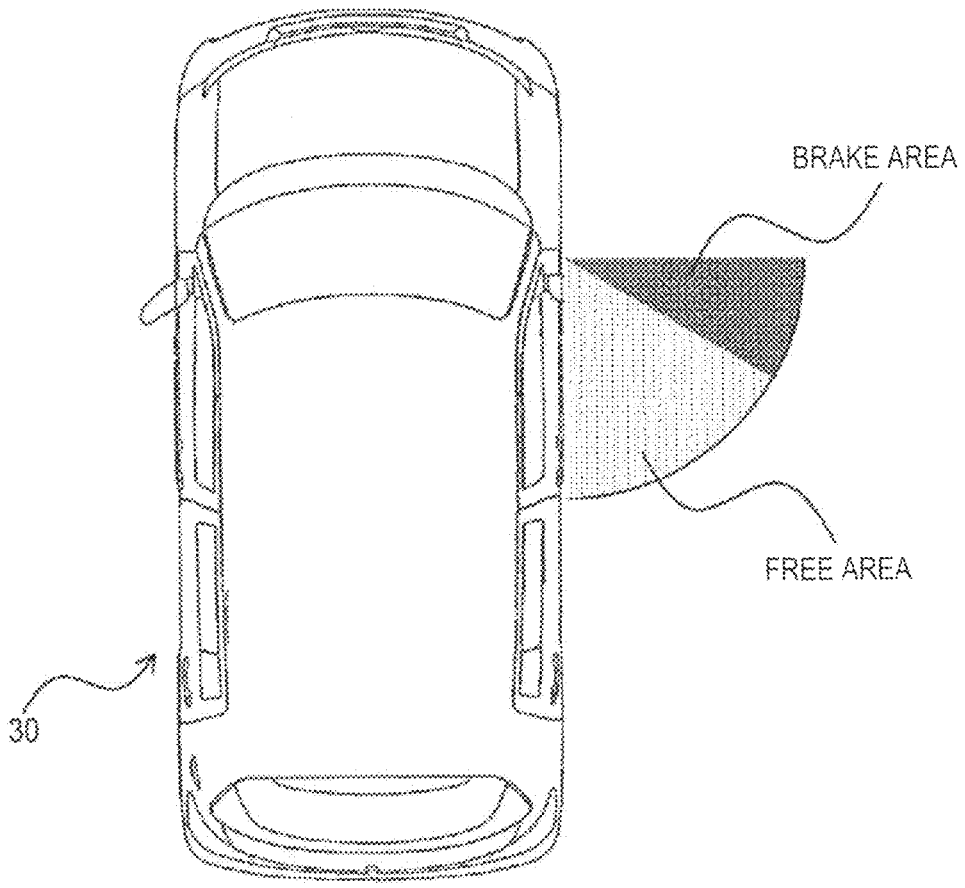
FIG. 12 is a schematic diagram showing an example of range setting of a free area and a brake area of the opening and closing body.

In FIG. 12, an example of range setting of the free area and the brake area is shown.

The control unit 26 further has a position detection signal receiving unit (fourth signal receiving unit) for receiving the output signal (a fourth detection signal) from the position detection sensor 20. The control unit 26 outputs a control signal for driving the holding force regulating device 24, according to the output signals from the contact detection sensor 12, the speed detection sensor 14, the displacement detection sensor 16, and the position detection sensor 20, thereby controlling the holding force of the opening and closing body 10.

Next, the opening and closing body control method according to this embodiment will be described by using FIGS. 11 and 13.

The holding force of the opening and closing body 10 is controlled as shown below according to, for example, a flowchart shown in FIG. 13 by the control unit 26. In addition, a flowchart for realizing the opening and closing body control method according to this embodiment is not limited to that shown in FIG. 13 and a modification or a change can be appropriately made in a range in which it is possible to exhibit the effects that this embodiment aims for.

First, in step S301, the control unit 26 receives the output signal from the position detection sensor 20. In a case where an output signal indicating that the opening and closing body 10 is fully closed has been received from the position detection sensor 20, the routine proceeds to step S302, and in a case where an output signal indicating that the opening and closing body 10 is in the free area or the brake area has been received, the routine proceeds to step S303.

In step S302, the control unit 26 outputs a holding force control signal for making the opening and closing body 10 have the holding force in the free state to the holding force regulating device 24, and thus the opening and closing body 10 is made to be in the free state by the holding force regulating device 24. In a case where the opening and closing body 10 is already in the free state, the free state is maintained. In this way, when the opening and closing body 10 is in the fully closed state, the opening and closing body 10 is maintained in the free state. After step S302, the routine returns to step S301.

The opening and closing body 10 is held by the door latch in the fully closed state, and therefore, the opening and closing body 10 may not be held by the holding force regulating device 24.

In step S303, the control unit 26 receives the output signal from the position detection sensor 20. In a case where an output signal indicating that the opening and closing body 10 is in the free area has been received from the position detection sensor 20, the routine proceeds to step S304, and thereafter, the processing of step S304 to step S310 is performed in the same manner as in step S201 to step S207 in Embodiment 2 shown in FIG. 9. After step S310, the routine returns to step S301.

In step S303, in a case where an output signal indicating that the opening and closing body 10 is in the brake area has been received from the position detection sensor 20, the routine proceeds to step S311.

In step S311, the control unit 26 receives the output signal from the contact detection sensor 12. In a case where an output signal indicating the contact of a user with the operating portion of the opening and closing body 10 has been received from the contact detection sensor 12, the routine proceeds to step S305 and the processing of step S305 to step S310 is performed in the same manner as in step S202 to step S207 in Embodiment 2 shown in FIG. 9. After step S310, the routine returns to step S301.

Even when the opening and closing body 10 is in the brake area, when there is the contact of the user, by making the opening and closing body 10 be in the free state, it is possible to improve the operability of the opening and closing body 10.

In step S311, in a case where an output signal indicating that the user is not in contact with the operating portion of the opening and closing body 10 has been received from the contact detection sensor 12, the routine proceeds to step S312.

In step S312, the control unit 26 outputs a holding force control signal for making the opening and closing body 10 have the holding force in the strong brake state to the holding force regulating device 24, and thus the opening and closing body 10 is made to be in the strong brake state by the holding force regulating device 24. In a case where the opening and closing body 10 is already in the strong brake state, the strong brake state is maintained. After step S312, the routine returns to step S301.

When the opening and closing body 10 has entered the brake area without the contact of the user, the opening and closing body 10 is made to be in the strong brake state, whereby it is possible to prevent the opening and closing body 10 from being opened without permission more than a predetermined degree of opening which can be set by the user. In this way, it is possible to prevent an accident such as the opening and closing body 10 being opened too much, thereby hitting another vehicle parked adjacently.

In addition, in step S311, a configuration may be made such that in a case where an output signal indicating that the user is not in contact with the operating portion of the opening and closing body 10 has been received from the contact detection sensor 12 and an output signal indicating that the opening and closing body 10 has been displaced in an opening direction has been received from the displacement detection sensor 16, the routine proceeds to step S312.

Further, in a case where the user is not in contact with the operating portion, the strong brake state of the opening and closing body 10 need not necessarily continue to be maintained. For example, in a case where a state where the opening and closing body 10 is moving at a speed less than a predetermined value has continued for a predetermined time, the holding state of the opening and closing body 10 may be changed from the strong brake state to the medium brake state. After the stop of the opening and closing body 10, the opening and closing body 10 is made to be in the medium brake state, whereby even if the opening and closing body 10 is operated without touching the contact detection sensor 12, it becomes possible to move the opening and closing body 10 in a closing direction, although it is heavy. In contrast, when an operation in an opening direction is performed, the opening and closing body 10 is changed to the strong brake state again, and therefore, it is not possible to move the opening and closing body 10.

It is also conceivable that the user wants to hold the opening and closing body 10 in the strong brake state in a state of being opened to an arbitrary degree of opening, regardless of the change of the holding state of the opening and closing body 10 in accordance with the steps described above. In preparation for such a case, a mechanism may be provided in which if a predetermined operation switch is operated in an opening state, the opening and closing body 10 forcibly enters the strong brake state.

If the operation switch enters an ON state, the control unit 26 outputs a holding force control signal for making the opening and closing body 10 have the holding force in the strong brake state to the holding force regulating device 24, and thus the opening and closing body 10 is made to be in the strong brake state by the holding force regulating device 24. The strong brake state is maintained until the operation switch enters an OFF state.

In this manner, according to this embodiment, the closed position, the free area, and the brake area are defined in a movable range of the opening and closing body 10 and the opening and closing body 10 is made to be in the strong brake state when the opening and closing body 10 has entered the brake area, and therefore, it is possible to prevent the opening and closing body 10 from being opened without permission more than a predetermined degree of opening which can be set by the user. In this way, it is possible to prevent an accident such as the opening and closing body 10 being opened too much, thereby hitting another vehicle parked adjacently.

Further, if the user comes into contact with the operating portion when the opening and closing body 10 is in the strong brake state, the holding force of the opening and closing body 10 enters the free state, and therefore, even when the opening and closing body 10 is in the brake area, it is possible to smoothly move the opening and closing body 10 with the intention of the user, and thus it is possible to improve operability.

Embodiment 5

Opening and closing body control method and apparatus according to Embodiment 5 disclosed here will be described by using FIGS. 14 to 16. The same constituent elements as those in the opening and closing body control methods and apparatuses according to Embodiments 1 to 4 shown in FIGS. 1 to 13 are denoted by the same reference numerals and description is omitted or simplified.

Figure 14:
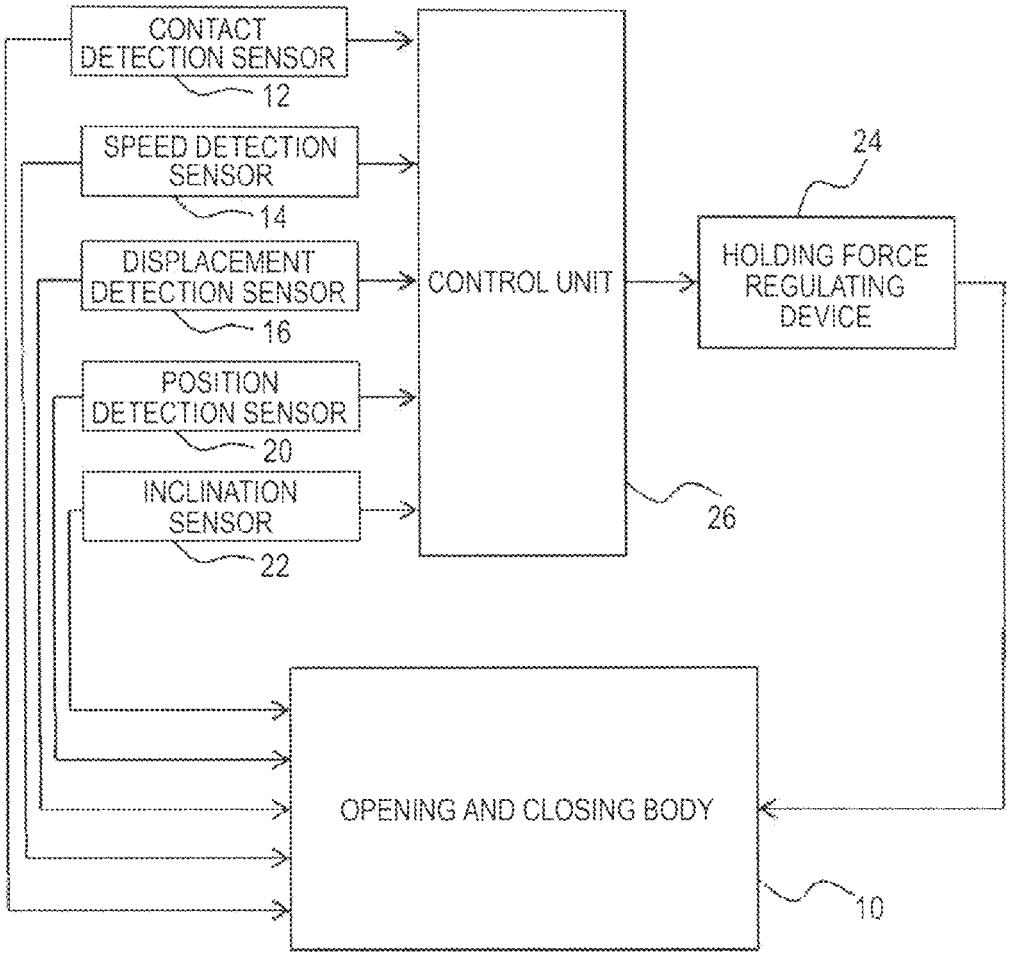
FIG. 14 is a block diagram showing the structure of an opening and closing body control apparatus according to Embodiment 5 disclosed here.

FIG. 14 is a block diagram showing the structure of the opening and closing body control apparatus according to this embodiment. FIG. 15 is a flowchart showing the opening and closing body control method according to this embodiment FIG. 16 is a transition diagram of a holding state of the opening and closing body in the opening and closing body control method according to this embodiment.

First, the structure of the opening and closing body control apparatus according to this embodiment will be described by using FIG. 14.

Figure 13:
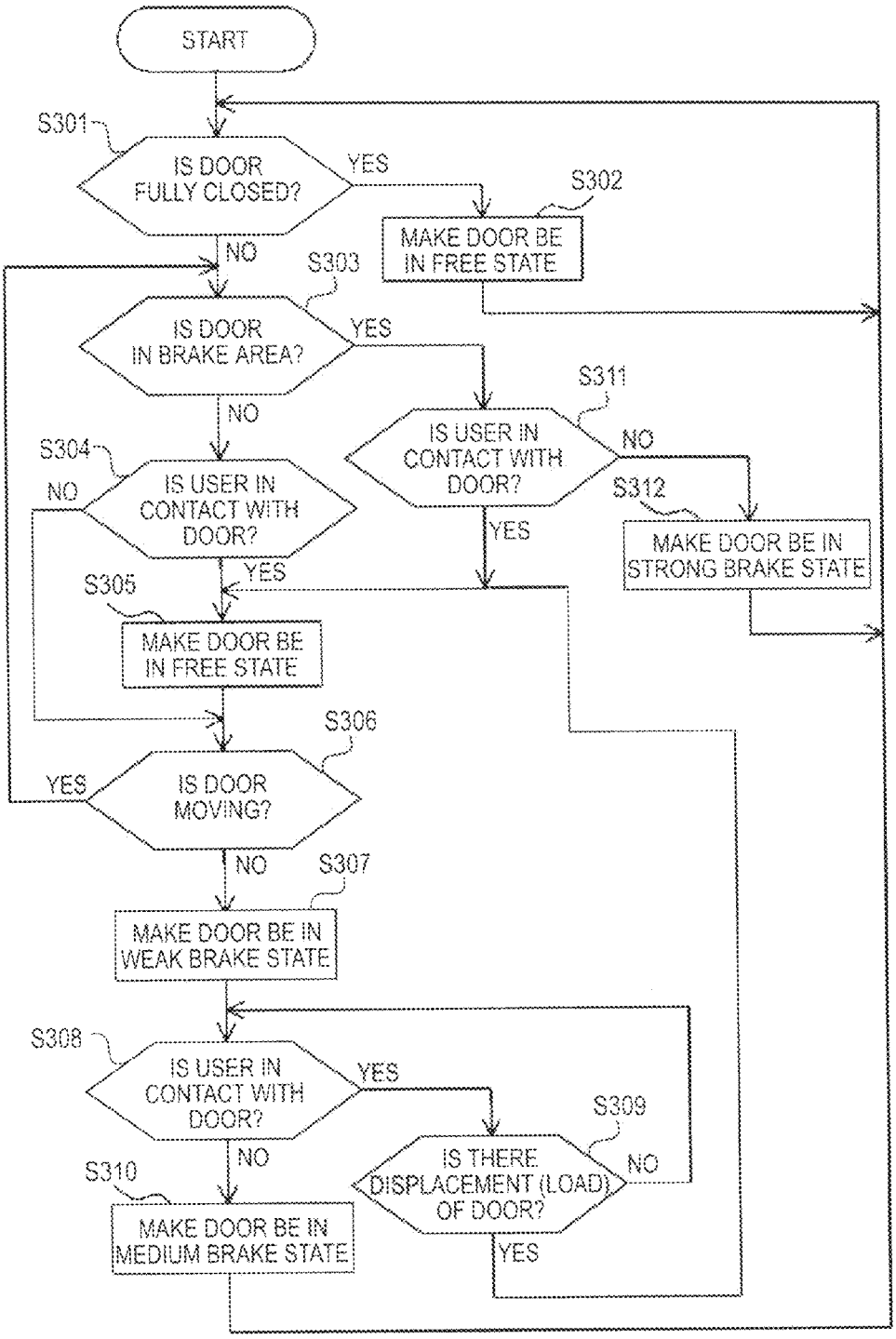
FIG. 13 is a flowchart showing an opening and closing body control method according to Embodiment 4 disclosed here.
Figure 15:
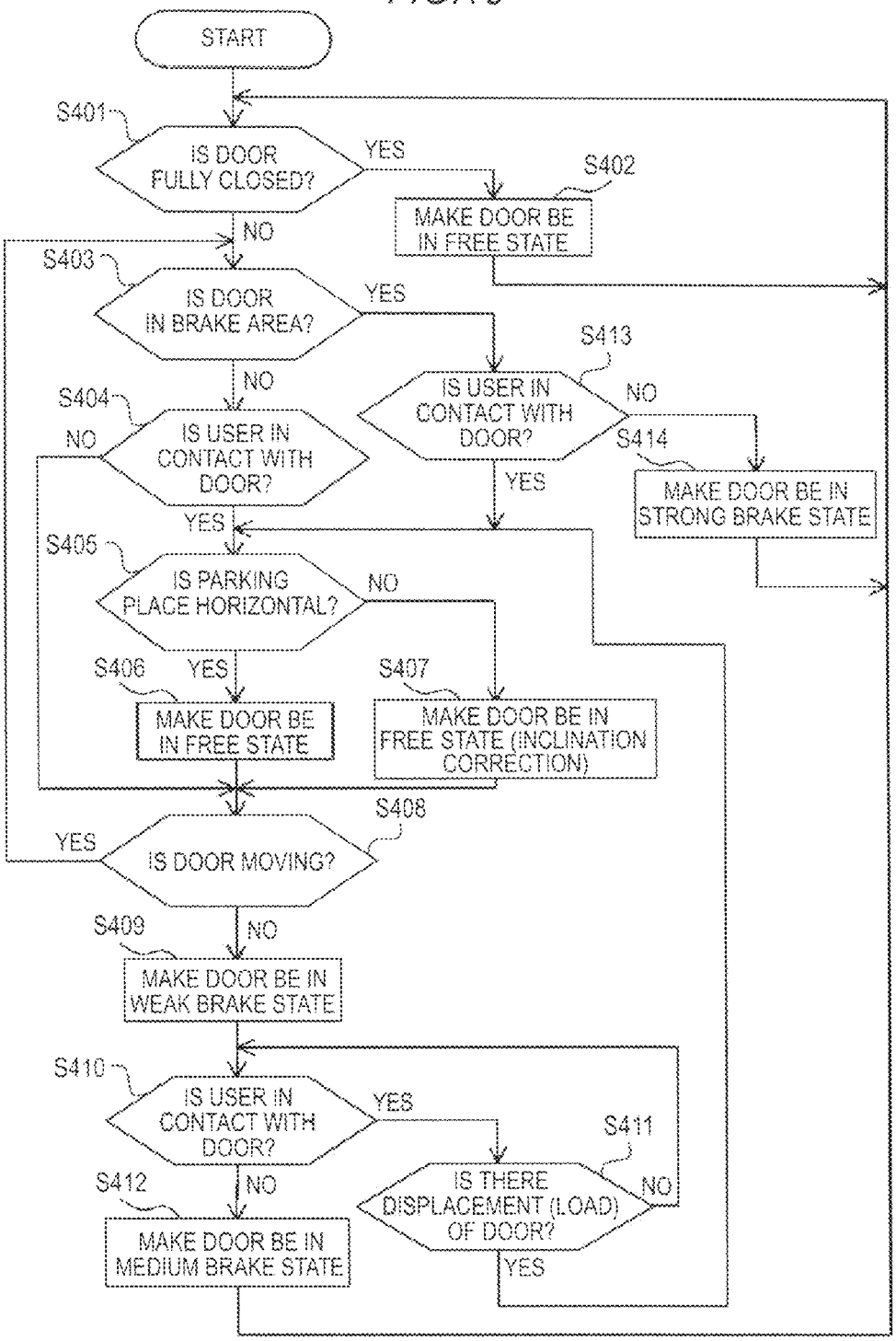
FIG. 15 is a flowchart showing an opening and closing body control method according to Embodiment 5 disclosed here.

The opening and closing body control apparatus according to this embodiment is the same as the opening and closing body control apparatus according to Embodiment 4 shown in FIG. 13 except that the opening and closing body control apparatus according to this embodiment further has an inclination sensor 22, as shown in FIG. 15. The control unit 26 is also connected to the inclination sensor 22 and is made so as to be able to receive an output signal from the inclination sensor 22.

The inclination sensor 22 is a sensor for detecting the inclination of the vehicle 30 with respect to a horizontal state. The sensor for detecting the inclination is not particularly limited.

The holding force regulating device 24 shall be able to form a holding state which is a "free state (inclination correction)", in addition to the three holding states, the "free state", the "weak brake state", and the "medium brake state".

Here, in this specification, the "free state (inclination correction)" is a state where the opening and closing body 10 is held by a brake force in the free state corrected based on the detection value of the inclination sensor 22. A holding force in the "free state (inclination correction)" is set to the extent that a sliding property is smaller than that in the "free state" but greater than that in the "weak brake state" and the opening and closing body 10 is not extremely accelerated due to inclination. The larger the gradient of the vehicle 30, the greater the holding force in the "free state (inclination correction)" becomes.

In addition, the expressions the "free state", the "free state (inclination correction)", the "weak brake state", the "medium brake state", and the "strong brake state", are for convenience in order to facilitate understanding, and the holding forces of the opening and closing body 10 in these states can be appropriately changed in consideration of necessity, convenience, or the like. In this specification, the holding force in the free state (inclination correction) is sometimes expressed as a fifth holding force.

The control unit 26 further has an inclination detection signal receiving unit (fifth signal receiving unit) for receiving the output signal (a fifth detection signal) from the inclination sensor 22. The control unit 26 outputs a control signal for driving the holding force regulating device 24, according to the output signals from the contact detection sensor 12, the speed detection sensor 14, the displacement detection sensor 16, the position detection sensor 20, and the inclination sensor 22, thereby controlling the holding force of the opening and closing body 10.

Next, the opening and closing body control method according to this embodiment will be described by using FIGS. 14 to 16.

The holding force of the opening and closing body 10 is controlled as shown below according to, for example, a flowchart shown in FIG. 15 by the control unit 26. In addition, a flowchart for realizing the opening and closing body control method according to this embodiment is not limited to that shown in FIG. 15 and a modification or a change can be appropriately made in a range in which it is possible to exhibit the effects that this embodiment aims for.

Since step S401 to step S403, step S413, and step S414 in this embodiment are the same as step S301 to step S303, step S311, and step S312 in Embodiment 4, description is omitted here.

In step S404, the control unit 26 receives the output signal from the contact detection sensor 12. In a case where an output signal indicating the contact of the user with the operating portion of the opening and closing body 10 has been received from the contact detection sensor 12, the routine proceeds to step S405, and in a case where an output signal indicating the contact of the user with the operating portion of the opening and closing body 10 has not been received, the routine proceeds to step S408.

In step S405, the control unit 26 receives the output signal from the inclination sensor 22. In a case where an output signal indicating that a parking place of the vehicle is horizontal or is less than or equal to a predetermined gradient which can be regarded as the horizontal has been received from the inclination sensor 22, the routine proceeds to step S406, and in a case where an output signal indicating that the vehicle has been parked on a slope having a gradient greater than the predetermined gradient has been received, the routine proceeds to step S407.

In step S406, the control unit 26 outputs a holding force control signal for making the opening and closing body 10 have the holding force in the free state to the holding force regulating device 24, and thus the opening and closing body 10 is made to be in the free state by the holding force regulating device 24. After step S406, the routine proceeds to step S408.

In step S407, the control unit 26 outputs a holding force control signal for making the opening and closing body 10 have the holding force in the free state (the free state (inclination correction)) according to the gradient of the vehicle to the holding force regulating device 24, and thus the opening and closing body 10 is made to be in the free state (inclination correction) by the holding force regulating device 24. After step S407, the routine proceeds to step S408.

The holding force of the opening and closing body 10 in a case where the vehicle is inclined is made to be the holding force in the free state (the free state (inclination correction)) according to the gradient of the vehicle, whereby it is possible to suppress acceleration when the opening and closing body 10 freely runs due to its own weight. In this way, it is possible to prevent the opening and closing body 10 from colliding with another vehicle parked adjacently or the user's hand or foot from being pinched, due to the user being unable to fully support the opening and closing body 10 due to the opening and closing body 10 moving with a speed and weight which are not expected by the user, or the like.

Figure 16:
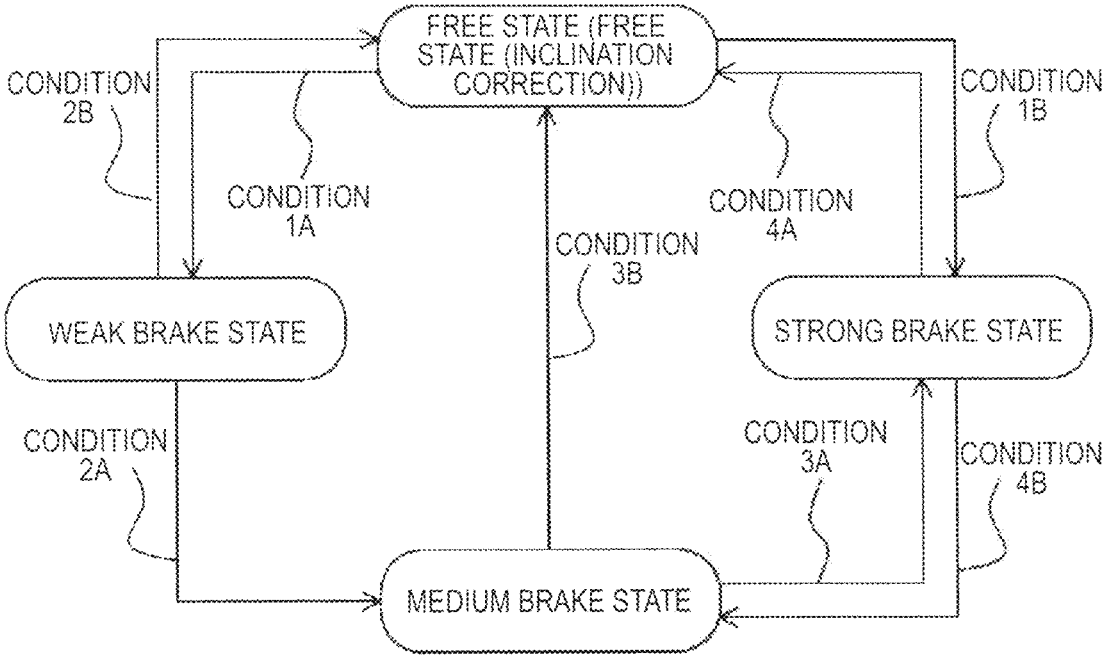
FIG. 16 is a transition diagram of a holding state of the opening and closing body in the opening and closing body control method according to Embodiment 5 disclosed here.

FIG. 16 is a transition diagram of the holding state of the opening and closing body 10 when the control along the flowchart described above is performed.

In a case where the opening and closing body 10 is in the free state, when a condition 1A is satisfied, the transition to the weak brake state is performed, and when a condition 1B is satisfied, the transition to the strong brake state is performed. Here, the condition 1A is a case where a state where the opening and closing body 10 is stopped or is moving at a speed less than or equal to a predetermined speed has continued for a predetermined time (step S408→step S409). The condition 1B is a case where the opening and closing body 10 is located in the brake area and the user is not in contact with the opening and closing body 10 (step S403→step S413→step S414). In addition, the "free state" also includes the "free state (inclination correction)".

In a case where the opening and closing body 10 is in the weak brake state, when a condition 2A is satisfied, the transition to the medium brake state is performed, and when a condition 2B is satisfied, the transition to the free state is performed. Here, the condition 2A is a case where the user has released the contact from the opening and closing body 10 (step S410→step S412). The condition 2B is a case where the operation (the displacement or the load) of the opening and closing body by the user has been detected (step S411→step S405→step S406 (step S407)).

In a case where the opening and closing body 10 is in the medium brake state, when a condition 3A is satisfied, the transition to the strong brake state is performed, and when a condition 3B is satisfied, the transition to the free state is performed. Here, the condition 3A is a case where the opening and closing body 10 is located in the brake area and the user has not come into contact with the opening and closing body 10 (step S403→step S413→step S414). The condition 3B is a case where the user has come into contact with the opening and closing body 10 (step S404→step S405→step S406 (step S407)).

In a case where the opening and closing body is in the strong brake state, when a condition 4A is satisfied, the transition to the free state is performed, and when a condition 4B is satisfied, the transition to the medium brake state is performed. Here, the condition 4A is a case where the user has come into contact with the opening and closing body 10 (step S404→step S405→step S406 (step S407)). The condition 4B is a case where a state where the opening and closing body 10 is stopped or is moving at a speed less than or equal to a predetermined speed has continued for a predetermined time.

In this manner, according to this embodiment, the holding force in the free state is corrected according to the gradient of the vehicle, and therefore, it is possible to suppress acceleration when the opening and closing body 10 freely runs due to its own weight in this way, it is possible to prevent the opening and closing body 10 from colliding with another vehicle parked adjacently or the user's hand or foot from being pinched, due to the user being unable to fully support the opening and closing body 10 due to the opening and closing body 10 moving with a speed and weight which are not expected by the user, or the like.

Modified Embodiments

This disclosure is not limited to the embodiments described above, and various modifications are possible.

For example, in Embodiment 4 described above, an example in which the position detection sensor 20 is further provided in the opening and closing body control apparatus according to Embodiment 2 or 3 has been shown. However, the position detection sensor 20 may be further provided in the opening and closing body control apparatus according to Embodiment 1.

Further, in Embodiment 5 described above, an example in which the inclination sensor 22 is further provided in the opening and closing body control apparatus according to Embodiment 4 has been shown. However, the inclination sensor 22 may be further provided in any one of the opening and closing body control apparatuses according to Embodiments 1 to 3.

Further, in the embodiments described above, a system configuration example has been shown assuming a case where the opening and closing body 10 is manually opened from the fully closed position. However, an opening and closing body driving device for automatically opening the opening and closing body 10 from the fully closed state to a predetermined degree of opening rather than the fully open state may be further incorporated. Such a pop-up mechanism is further provided, whereby it is possible to easily and smoothly perform a door opening operation by a user.

An aspect of this disclosure provides an opening and closing body control apparatus including: a first signal receiving unit configured to receive a first detection signal indicating the presence or absence of contact of a user with an operating portion of an opening and closing body; a second signal receiving unit configured to receive a second detection signal indicating a movement speed of the opening and closing body; and a signal output unit configured to output a control signal for regulating a holding force of the opening and closing body to a holding force regulating device, wherein the control signal for regulating the holding force of the opening and closing body to a first holding force less than a second holding force is output to the holding force regulating device according to the first detection signal indicating that the contact of the user with the operating portion has been detected, and when the second detection signal indicating that the movement speed of the opening and closing body is greater than or equal to a predetermined speed is received when the holding force of the opening and closing body is the first holding force, the control signal for regulating the holding force of the opening and closing body to the first holding force is output to the holding force regulating device regardless of the first detection signal.

The opening and closing body control apparatus according to the aspect of this disclosure may be configured such that, when the second detection signal indicating that the movement speed of the opening and closing body is less than the predetermined speed is received when the holding force of the opening and closing body is the first holding force, the control signal for switching the holding force of the opening and closing body to the second holding force is output to the holding force regulating device.

The opening and closing body control apparatus according to the aspect of this disclosure may be configured such that, when the first detection signal indicating that the user is not in contact with the operating portion is received when the holding force of the opening and closing body is the second holding force, the control signal for switching the holding force of the opening and closing body to a third holding force greater than the second holding force is output to the holding force regulating device.

The opening and closing body control apparatus according to the aspect of this disclosure may be configured such that the opening and closing body control apparatus further includes a third signal receiving unit configured to receive a third detection signal indicating displacement of the opening and closing body, and when the first detection signal indicating that contact of the user with the operating portion has been detected and the third detection signal indicating that the opening and closing body has been displaced are received when the holding force of the opening and closing body is the second holding force, the control signal for switching the holding force of the opening and closing body to the first holding force is output to the holding force regulating device.

The opening and closing body control apparatus according to the aspect of this disclosure may be configured such that the opening and closing body control apparatus further includes a fourth signal receiving unit configured to receive a fourth detection signal indicating a position where the opening and closing body is located, among a closed position, a free area to allow a movement of the opening and closing body, and a brake area to limit further opening movement of the opening and closing body, and when the fourth detection signal indicating that the opening and closing body is in the brake area and the first detection signal indicating that the user is not in contact with the operating portion are received, the control signal for switching the holding force of the opening and closing body to a fourth holding force greater than the second holding force is output to the holding force regulating device.

The opening and closing body control apparatus according to the aspect of this disclosure may be configured such that the opening and closing body control apparatus further includes: a third signal receiving unit configured to receive a third detection signal indicating displacement of the opening and closing body; and a fourth signal receiving unit configured to receive a fourth detection signal indicating a position where the opening and closing body is located, among a closed position, a free area to allow a movement of the opening and closing body, and a brake area to limit further opening movement of the opening and closing body, and when the fourth detection signal indicating that the opening and closing body is in the brake area and the third detection signal indicating that a direction of displacement of the opening and closing body is an opening direction are received, the control signal for switching the holding force of the opening and closing body to a fourth holding force greater than the second holding force is output to the holding force regulating device.

The opening and closing body control apparatus according to the aspect of this disclosure may be configured such that the brake area is configured to be able to be changed to a desired range.

The opening and closing body control apparatus according to the aspect of this disclosure may be configured such that the opening and closing body control apparatus further includes: a fifth signal receiving unit configured to receive a fifth detection signal indicating a gradient of a vehicle, and when the fifth detection signal indicating that the vehicle is inclined more than a predetermined gradient is received, the control signal for regulating the holding force of the opening and closing body to a fifth holding force greater than the first holding force according to the gradient of the vehicle, in place of the first holding force, and smaller than the second holding force is output to the holding force regulating device.

The opening and closing body control apparatus according to the aspect of this disclosure may be configured such that the signal output unit has a unit configured to output the control signal for forcibly regulating the holding force of the opening and closing body to a fourth holding force greater than the second holding force by an intention of the user.

Another aspect of this disclosure provides an opening and closing body control method of a vehicle having a contact detection sensor which detects the presence or absence of contact of a user with an operating portion of an opening and closing body, a speed detection sensor which detects a movement speed of the opening and closing body, and a holding force regulating device for regulating a holding force of the opening and closing body, the method including: regulating the holding force of the opening and closing body to a first holding force less than a second holding force according to a first detection signal indicating that the contact of the user with the operating portion has been detected; and maintaining the holding force of the opening and closing body at the first holding force regardless of the first detection signal when a second detection signal indicating that the movement speed of the opening and closing body is greater than or equal to a predetermined speed is received when the holding force of the opening and closing body is the first holding force.

The opening and closing body control apparatus according to the aspect of this disclosure may be configured such that, when the second detection signal indicating that the movement speed of the opening and closing body is less than the predetermined speed is received when the holding force of the opening and closing body is the first holding force, the holding force of the opening and closing body is switched to the second holding force.

Still another aspect of this disclosure is directed to an opening and closing body control method of a vehicle having a contact detection sensor which detects the presence or absence of contact of a user with an operating portion of an opening and closing body, a speed detection sensor which detects a movement speed of the opening and closing body, and a holding force regulating device for regulating a holding force of the opening and closing body. The method includes: regulating the holding force of the opening and closing body to a first holding force less than a second holding force according to a first detection signal indicating that the contact of the user with the operating portion has been detected; and maintaining the holding force of the opening and closing body at the first holding force regardless of the first detection signal when a second detection signal indicating that the movement speed of the opening and closing body is greater than or equal to a predetermined speed is received when the holding force of the opening and closing body is the first holding force.

The opening and closing body control method according to the aspect of this disclosure may be configured such that, when the second detection signal indicating that the movement speed of the opening and closing body is less than the predetermined speed is received when the holding force of the opening and closing body is the first holding force, the holding force of the opening and closing body is switched to the second holding force.

According to the aspects of this disclosure, even when a user releases the hand from the opening and closing body in an attempt to open and shut the opening and closing body with inertia by giving momentum thereto, the opening and closing body can be operated according to the intention of the user without becoming a door holding mode. In this way, it is possible to improve the operability of the opening and closing body, as compared to a case of controlling the holding force of the opening and closing body based on only a signal of a sensor which detects the presence or absence of contact of a user.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. An opening and closing body control apparatus comprising:

a first signal receiving unit configured to receive a first detection signal indicating the presence or absence of contact of a user with an operating portion of an opening and closing body;

a second signal receiving unit configured to receive a second detection signal indicating a movement speed of the opening and closing body; and a signal output unit configured to output a control signal for regulating a holding force of the opening and closing body to a holding force regulating device, wherein the control signal for regulating the holding force of the opening and closing body to a first holding force less than a second holding force is output to the holding force regulating device according to the first detection signal indicating that the contact of the user with the operating portion has been detected, and when the second detection signal indicating that the movement speed of the opening and closing body is greater than or equal to a predetermined speed is received when the holding force of the opening and closing body is the first holding force, the control signal for regulating the holding force of the opening and closing body to the first holding force is output to the holding force regulating device regardless of the first detection signal.

2. The opening and closing body control apparatus according to claim 1, wherein when the second detection signal indicating that the movement speed of the opening and closing body is less than the predetermined speed is received when the holding force of the opening and closing body is the first holding force, the control signal for switching the holding force of the opening and closing body to the second holding force is output to the holding force regulating device.

3. The opening and closing body control apparatus according to claim 2, wherein when the first detection signal indicating that the user is not in contact with the operating portion is received when the holding force of the opening and closing body is the second holding force, the control signal for switching the holding force of the opening and closing body to a third holding force greater than the second holding force is output to the holding force regulating device.

4. The opening and closing body control apparatus according to claim 2, further comprising:

a third signal receiving unit configured to receive a third detection signal indicating displacement of the opening and closing body, wherein when the first detection signal indicating that contact of the user with the operating portion has been detected and the third detection signal indicating that the opening and closing body has been displaced are received when the holding force of the opening and closing body is the second holding force, the control signal for switching the holding force of the opening and closing body to the first holding force is output to the holding force regulating device.

5. The opening and closing body control apparatus according to claim 1, further comprising:

a fourth signal receiving unit configured to receive a fourth detection signal indicating a position where the opening and closing body is located, among a closed position, a free area to allow a movement of the opening and closing body, and a brake area to limit further opening movement of the opening and closing body, wherein when the fourth detection signal indicating that the opening and closing body is in the brake area and the first detection signal indicating that the user is not in contact with the operating portion are received, the control signal for switching the holding force of the opening and closing body to a fourth holding force greater than the second holding force is output to the holding force regulating device.

6. The opening and closing body control apparatus according to claim 1, further comprising:

a third signal receiving unit configured to receive a third detection signal indicating displacement of the opening and closing body; and a fourth signal receiving unit configured to receive a fourth detection signal indicating a position where the opening and closing body is located, among a closed position, a free area to allow a movement of the opening and closing body, and a brake area to limit further opening movement of the opening and closing body, wherein when the fourth detection signal indicating that the opening and closing body is in the brake area and the third detection signal indicating that a direction of displacement of the opening and closing body is an opening direction are received, the control signal for switching the holding force of the opening and closing body to a fourth holding force greater than the second holding force is output to the holding force regulating device.

7. The opening and closing body control apparatus according to claim 5, wherein the brake area is configured to be able to be changed to a desired range.

8. The opening and closing body control apparatus according to claim 1, further comprising:

a fifth signal receiving unit configured to receive a fifth detection signal indicating a gradient of a vehicle, wherein when the fifth detection signal indicating that the vehicle is inclined more than a predetermined gradient is received, the control signal for regulating the holding force of the opening and closing body to a fifth holding force greater than the first holding force according to the gradient of the vehicle, in place of the first holding force, and smaller than the second holding force is output to the holding force regulating device.

9. The opening and closing body control apparatus according to claim 1, wherein the signal output unit has a unit configured to output the control signal for forcibly regulating the holding force of the opening and closing body to a fourth holding force greater than the second holding force by an intention of the user.

10. An opening and closing body control apparatus comprising:

a contact detection sensor which detects the presence or absence of contact of a user with an operating portion of an opening and closing body;

a speed detection sensor which detects a movement speed of the opening and closing body;

a holding force regulating device which regulates a holding force of the opening and closing body; and a control unit which controls the holding force regulating device based on detection results by the contact detection sensor and the speed detection sensor, wherein the control unit regulates the holding force of the opening and closing body to a first holding force less than a second holding force according to a first detection signal indicating that the contact of the user with the operating portion has been detected, and maintains the holding force of the opening and closing body at the first holding force regardless of the first detection signal when a second detection signal indicating that the movement speed of the opening and closing body is greater than or equal to a predetermined speed is received when the holding force of the opening and closing body is the first holding force.

11. The opening and closing body control apparatus according to claim 10, wherein when the second detection signal indicating that the movement speed of the opening and closing body is less than the predetermined speed is received when the holding force of the opening and closing body is the first holding force, the holding force of the opening and closing body is switched to the second holding force.

12. An opening and closing body control method of a vehicle having a contact detection sensor which detects the presence or absence of contact of a user with an operating portion of an opening and closing body, a speed detection sensor which detects a movement speed of the opening and closing body, and a holding force regulating device which regulates a holding force of the opening and closing body, the method comprising:

regulating the holding force of the opening and closing body to a first holding force less than a second holding force according to a first detection signal indicating that the contact of the user with the operating portion has been detected; and maintaining the holding force of the opening and closing body at the first holding force regardless of the first detection signal when a second detection signal indicating that the movement speed of the opening and closing body is greater than or equal to a predetermined speed is received when the holding force of the opening and closing body is the first holding force.

13. The opening and closing body control method according to claim 12, wherein when the second detection signal indicating that the movement speed of the opening and closing body is less than the predetermined speed is received when the holding force of the opening and closing body is the first holding force, the holding force of the opening and closing body is switched to the second holding force.

* * * * *